US005497627A

United States Patent [19]

Heyduk et al.

[11] Patent Number: 5,497,627

[45] Date of Patent: Mar. 12, 1996

[54] METHODS FOR PURIFYING REFRIGERANT COMPOSITIONS

[75] Inventors: Alan F. Heyduk, Columbus; Robert W. Mouk, Westerville; Albert E. Abel, Powell, all of Ohio

[73] Assignee: Commodore Laboratories, Inc., Columbus, Ohio

[21] Appl. No.: 361,039

[22] Filed: Dec. 21, 1994

[51] Int. Cl.[6] ..... F25B 47/00; B01D 12/00; B01D 43/00

[52] U.S. Cl. ..... 62/85; 62/292; 210/513; 210/532.1

[58] Field of Search ..... 62/77, 85, 292, 62/475; 210/773, 774, 175, 511, 513, 532.1, 533; 55/421, 229, 220, 228

[56] References Cited

U.S. PATENT DOCUMENTS 2,747,680 5/1956 Kilpatrick ..... 210/513
3,080,057 3/1963 Mobley ..... 210/532.1
4,202,778 5/1980 Middelbeek ..... 210/522
5,165,253 11/1992 Komagasawa et al. ..... 62/292
5,201,918 4/1993 Vobach ..... 62/77
5,209,074 5/1993 McConnell ..... 62/85

*Primary Examiner*—Henry A. Bennett
*Assistant Examiner*—William C. Doerrler
*Attorney, Agent, or Firm*—Howard M. Ellis

[57] ABSTRACT

Improved methods for purification and recovery of individual refrigerants from refrigerant mixtures without chemical destruction of the contaminating refrigerant. Aqueous solutions are employed in extraction methods by relying on differences in water solubilities and partition coefficients at ambient temperatures. All refrigerants can be recovered and the aqueous solutions reused to form a cyclic process. Methods include countercurrent extraction.

20 Claims, 4 Drawing Sheets

METHODS FOR PURIFYING REFRIGERANT COMPOSITIONS

TECHNICAL FIELD

The present invention relates generally to the reclamation of chlorofluorocarbons (CFCs), and more specifically, to methods of purifying and recovering refrigerants from refrigerant mixtures for recycling/reuse.

BACKGROUND OF THE INVENTION

Chlorofluorocarbons (CFCs) are synthetic chemical compounds widely used in refrigeration and air conditioning; as aerosol propellants and solvents; in forming foams, including those used in fast-food packaging; and in rigid insulation. Scientists now see these synthetic chemicals as the main threat to Earth's protective ozone layer. Because CFCs are immune to destruction in the troposphere, and because they eventually float upwardly, their manufacture and release have lead to the accumulation of large amounts in the stratosphere. In the stratosphere, CFCs are broken down by sunlight into chlorine, which has a catalytic and destructive effect on ozone. The result has been a significant decline in the global ozone shield and an increase in the amount of harmful ultraviolet radiation reaching the surface of Earth. According to a United Nations' study, every 1 percent drop in ozone will lead to a 3 percent increase in non-melanoma skin cancers in light-skinned people, as well as dramatic increases in cataracts, lethal melanoma cancers, and damage to the human immune system. Higher levels of UV light may also worsen ground-level pollution and hurt plants, animals, and especially light sensitive aquatic organisms.

As a result, destruction of CFCs, and in some instances, reclamation of CFC refrigerants is a vital component of the national and global strategies for protection of the earth's ozone layer in a manner consistent with minimal economic disruptions associated with the phase-out of this class of chemicals. There are still sizable reserves of CFCs on hand which must be treated and converted to environmentally benign substances. Likewise, until existing refrigeration and air conditioning equipment is replaced or retrofitted with devices which are capable of operating with more environmentally friendly refrigerants, as CFC production is curtailed and eventually eliminated, industry and consumers must rely increasingly on the availability of reclaimed refrigerants.

However, successful reclamation is presently hampered due to the occurrence of inadvertent contamination of refrigerants by other refrigerants. In order to qualify for reuse, reclaimed refrigerants are required to meet the American Refrigeration Institute's "700" specifications which stipulate the permissible levels of contaminants. That is, strict limits are placed on moisture, particulates, acidity, oil content, non-condensible gases, and other refrigerants present. Existing refrigeration and air conditioning equipment appears capable of employing reclaimed refrigerants. Existing reclamation processes are capable of meeting all of the foregoing criteria with the exception of "other refrigerants", which are not permitted to exceed 0.5 percent maximum.

One example of a widely found refrigerant mixture is Freon® 12, a trademark of E. I. DuPont, which is dichlorodifluoromethane, contaminated with Freon 22, which is chlorodifluoromethane, hereinafter called R-12 and R-22, respectively. Although removal of the unwanted R-22 contaminant from such a mixture would appear to be readily accomplished by distillation due to differences in their boiling points (R-12 b.p. −29.8° C. and R-22 b.p. −41° C.), separation by distillation is not readily achieved due to the formation of an azeotrope consisting of 75 percent R-22, when the two refrigerants become mixed.

Other known technologies for the destruction of CFCs such as thermal oxidation, catalytic decomposition, supercritical water oxidation, plasma destruction methods, biological processes, UV photolysis, and so on, are either in experimental stages of development, economically unattractive or incapable of selectively destroying the unwanted contaminating refrigerant without also eliminating the desired refrigerant.

Useful methods for purification of refrigerant mixtures have been disclosed in copending application Ser. Nos. 207,286 and 207,289 filed Mar. 7, 1994. Such methods are especially useful in reclamation processes where production of certain CFCs, such as R-12 are being phased-out of production, but market demand remains strong. While such methods provide efficient and economic means for selectively purifying refrigerant compositions comprising two or more refrigerants without eliminating the desired refrigerant, the methods usually result in the dehalogenation and destruction of at least one of the refrigerants, i.e., the contaminating refrigerant, such as R-22.

Accordingly, it would be desirable to have alternative methods for efficient purification of refrigerants in short supply or which are being phased out of production, but which have become contaminated with other refrigerants. Such methods of purification should enable the separation and recovery of refrigerants without chemical destruction of potentially useful other refrigerants.

SUMMARY OF THE INVENTION

In accordance with the invention, improved methods are provided in the purification of refrigerants which have become contaminated with other refrigerants.

The term "refrigerant" as used throughout the specification and claims is intended to mean fluorocarbon compounds as a class of chemicals which are suitable for use in refrigeration and air conditioning equipment. Likewise, the term is also intended to include fluorocarbons which are useful as solvents, aerosol propellants, in manufacturing synthetic foams, packaging, insulation, and the like. Thus, it should be understood "refrigerant" is intended to embrace a broader range of fluorocarbons then merely those which are suitable for air conditioning and refrigeration applications. They include products commercially available under trademarks, such as Freon, Halon, Frigen, Arcton, Genetron, Isotron, and others.

The expression "other refrigerant" is used herein to denote the contaminating refrigerant component of the refrigerant composition for separation from the primary refrigerant. The primary refrigerant is that refrigerant present in the composition in the greatest concentration.

It is therefore a principal object of the invention to provide methods for extraction of refrigerants from refrigerant mixtures by the steps of:

(a) providing a refrigerant composition comprising at least first and second refrigerants in which the first refrigerant has a high water solubility relative to the second refrigerant;

(b) in a closed vessel, contacting the refrigerant composition of step (a) with an aqueous solution at a temperature sufficiently low to enhance the solubility and extraction of the first refrigerant from the refrigerant composition;

(c) allowing the aqueous solution of the extracted first refrigerant to separate into an upper aqueous phase and a lower liquid phase comprising the second refrigerant;

(d) separating the upper aqueous phase from the lower liquid phase, and (e) recovering the first refrigerant from the aqueous phase to provide a first refrigerant suitable for recycling/reuse.

Aqueous solutions as recited above are preferably water. Typical refrigerant compositions containing first and second refrigerants of step (a) include, but are not limited to, dichlorodifluoromethane, chlorodifluoromethane and chloropentafluoroethane (Freon 115).

It is yet another principal object to provide a further embodiment of an extraction method for purifying refrigerant compositions by the steps of:

(a) providing a refrigerant composition comprising at least first and second refrigerants, the first refrigerant having a high water solubility relative to the second refrigerant;

(b) providing an aqueous solution having a temperature sufficiently low to enhance the solubility and extraction of the first refrigerant from the refrigerant composition of step (a);

(c) circulating a stream of the refrigerant composition of step (a) in a closed vessel countercurrently to a stream of the aqueous solution of step (b) for extraction of the first refrigerant by the aqueous solution;

(d) withdrawing the aqueous solution of step (c) comprising the extracted first refrigerant, and (e) separating the first refrigerant from the aqueous solution to provide a first refrigerant suitable for recycling/reuse.

Accordingly, the invention enables the separation and recovery of refrigerants from multi-refrigerant-containing compositions without the destruction of other refrigerants.

BRIEF DESCRIPTION OF THE DRAWINGS

For a further understanding of the invention and its characterizing features reference should now be made to the accompanying drawings wherein.

DESCRIPTION OF THE PREFERRED EMBODIMENTS

The invention relates to improved methods for purification and recovery of individual refrigerants from refrigerant mixtures wherein the recovered refrigerants are suitable for recycling. The methods are especially useful in treating CFCs, such as used Freon 12 which is being phased-out of production, but is unsuitable for reuse because of contamination with unacceptably high levels of other refrigerants.

The invention does not depend on modification of chemical compounds at the molecular level, but instead on more environmentally friendly extraction methods by relying on differences in aqueous solubilities and partition coefficients between the refrigerants forming the mixtures. Hence, the processes are especially unique in allowing for the separation and recovery of all refrigerant components. The methods also allow for effective separation of refrigerants having similar boiling points and azeotropes, such as Freons 12 and 22 which otherwise cannot be readily separated by distillation methods.

Figure 1:
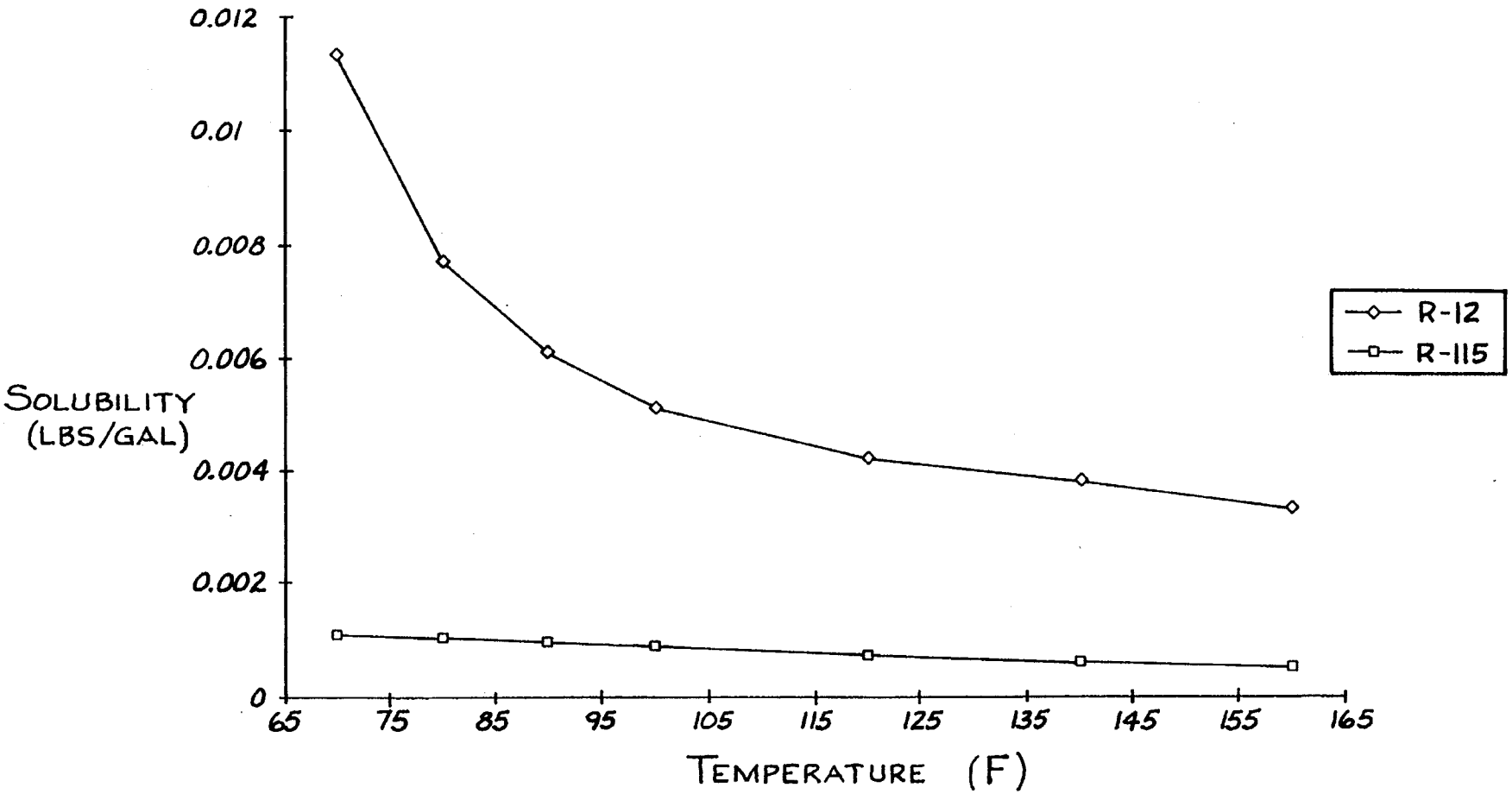
FIG. 1 is a graphical representation of the relative solubilities of dichlorodifluoromethane and chloropentafluoroethane in water as a function of temperature at 50 psia.
Figure 2:
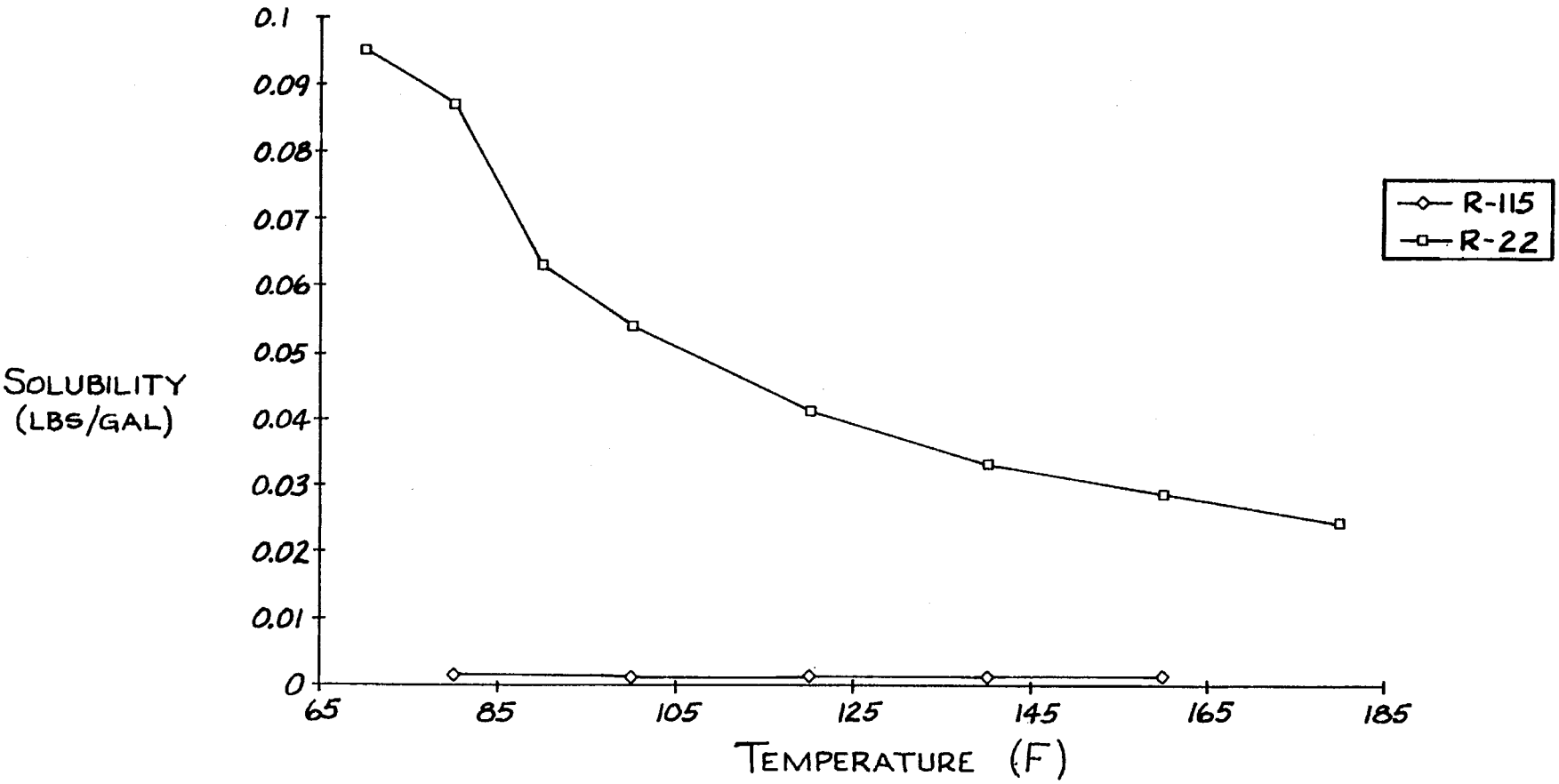
FIG. 2 is a graphical representation of the relative solubilities of chlorodifluoromethane and chloro-pentafluoroethane in water as a function of temperature at 50 psia.
Figure 3:
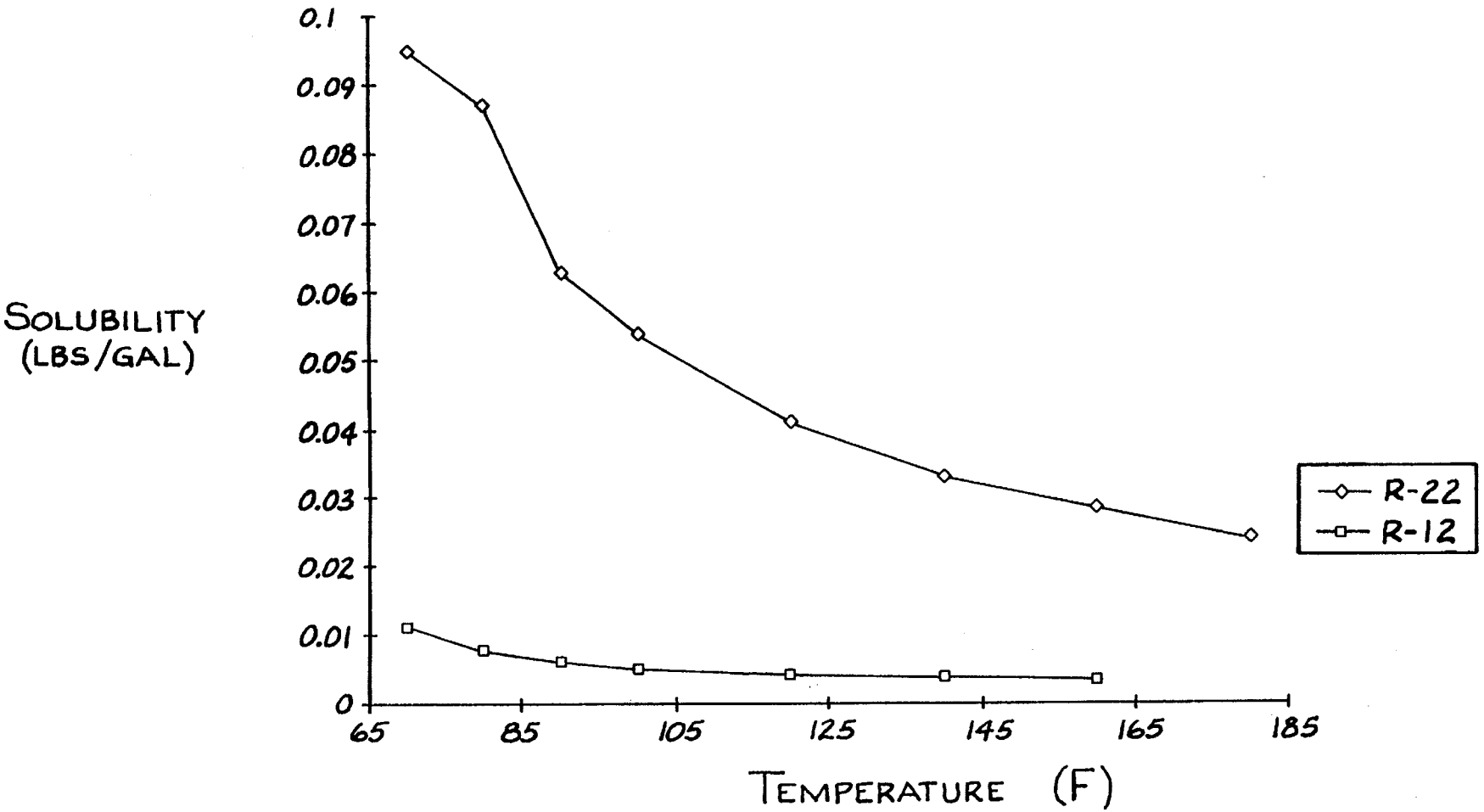
FIG. 3 is a graphical representation of the relative solubilities of chlorodifluoromethane and dichlorodifluoromethane in water as a function of temperature at 50 psia.

FIGS. 1–3 illustrate the relative solubilities of commercially important, but potentially scarce CFCs in water, namely dichlorodifluoromethane (R-12) which is frequently contaminated with chlorodifluoromethane (R-22) and/or chloropentafluoroethane (R-115). The inventors observed R-12 and R-22 were substantially more soluble in water relative to R-115 at temperatures in a range from about 65° to about 120° F. More preferable separation temperatures were found to be in a range from about 65° to about 90° F. More optimally, refrigerants such as R-12 and R-22 have greater solubility in water at temperatures ranging from about 70° to about 80° F. relative to the solubility of R-115 at the same temperature. It was also observed the solubility of R-22 in water at ambient temperature conditions was greater relative to R-12.

Hence, the methods comprise extracting, and more preferably, analytically extracting refrigerant mixtures in aqueous solutions at temperatures sufficiently low to optimize the separation of one refrigerant of the mixture relative to the other. The expression "aqueous solution" refers to the liquid used in the extraction process, and includes mainly water, i.e. at least about 50 percent water, and more preferably 50 to 100 percent by weight water. The water may include other solvents, and particularly polar organic solvents, such as alcohols like methanol and ethanol.

Advantageously, the aqueous solutions containing the extracted refrigerant are not readily miscible in the solutions containing the refrigerant mixtures being purified. As a result, the aqueous solution forms a separate phase from the mixed solution of refrigerants which can be withdrawn from the extraction vessel. The refrigerant can be recovered from the aqueous solution by raising the temperature and lowering the pressure to atmospheric or negative pressure to cause the refrigerant to separate.

The following specific examples demonstrate the invention. However, it is to be understood they are for illustrative purposes only and do not purport to be wholly definitive as to conditions and scope.

EXAMPLE I

Figure 4:
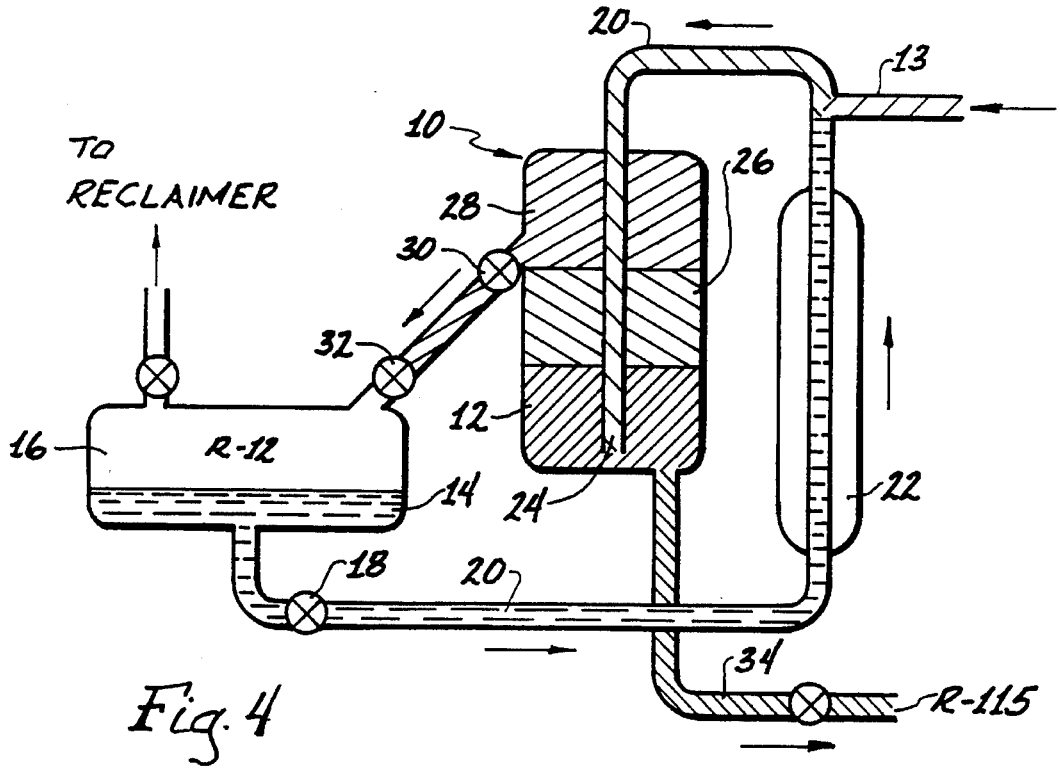
FIG. 4 is a schematic view of a first embodiment for extracting and recovering refrigerants according to the invention.

Methods of the invention are carried out by means of a closed system, such as that illustrated in FIG. 4. A mixed liquid refrigerant 12 consisting of R-12 and R-115, is charged to a closed extraction flask 10 via line 13. The mixed refrigerant 12 exists as a lower liquid layer in the flask which is maintained at 70° F. under elevated pressure. Heated water 14 from reclaiming flask 16 is withdrawn by opening valve 18 in line 20. The water is cooled to about 70° F. by means of an in-line cooler 22. Cooled water is discharged in the mixed refrigerant 12 in extraction flask 10 through a perforated distributor sparger tube 24 where it intimately mixes with the refrigerants. Because liquid refrigerant 12 is significantly denser than the water, the refrigerant remains as a lower phase in the extraction flask.

The water mixing with the refrigerant extracts the R-12 from the refrigerant mixture in the lower layer due to the greater solubility of the R-12 than the R-115 in water at ambient temperatures. The aqueous solution of R-12 rises to the surface of lower liquid phase 12 to form a top water-refrigerant phase 26. Flask 10 is equipped with an exit port 28 at the upper region of the vessel. Opening valves 30 and 32 allows controlled volumes of water from the top water phase-26 containing R-12 refrigerant values to drain off the extraction flask to reclaiming flask 16. Valves 30 and 32 not only regulate the flow of water and refrigerant from the extraction flask they also allow different pressures to exist in the extraction and reclaiming flasks.

The R-12 refrigerant and water mixture collected in the reclaiming flask is then heated at reduced pressure or under reduced pressure to facilitate separation of the refrigerant from the water. The R-12 rapidly boils off and is transferred to a reclaimer for reliquification. Water in the reclaiming flask 16 is then available for recycling to the extraction flask 10. The lower liquid phase 12 in the extraction flask containing residual R-115 is substantially free of R-12 values, and can be recovered from line 34 for reuse.

EXAMPLE II

Figure 5:
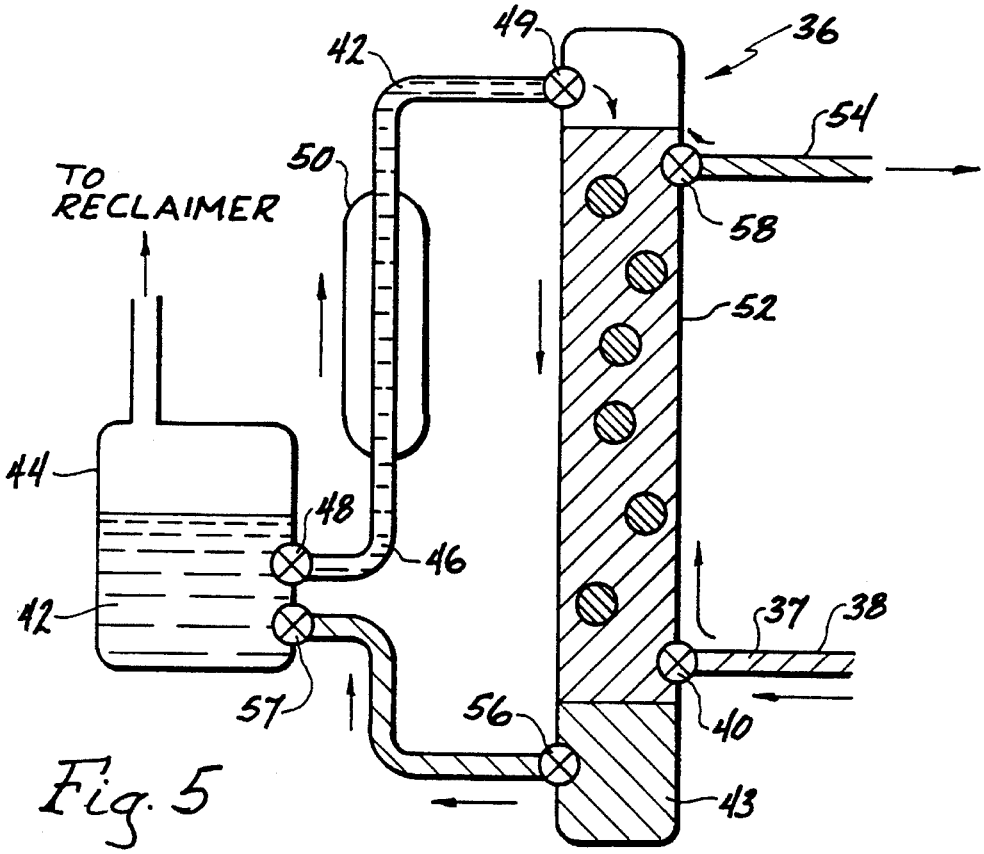
FIG. 5 is a schematic view of a second embodiment for extracting and recovering refrigerants according to the invention.

Methods for purification of refrigerant mixtures may also be practiced by an alternative embodiment with a counter-current extraction system 36 (FIG. 5). A mixed refrigerant 37 consisting of R-22 and R-115, for example, is introduced into the pressurized extraction system through line 38 by opening valve 40. Simultaneously, water 42 from reclaiming vessel 44 is introduced into the system via line 46 by opening valves 48 and 49. Because the water from reclaiming vessel 44 is heated the temperature is lowered by means of an in-line cooler 50° to about 70° F. The cooled water 42 enters extraction column 52 at the upper end and the mixed refrigerant 37 enters the column at the lower end. The total volume of the mixed refrigerant liquid should be about ¾ of the total volume of the column. For refrigerant mixtures having relatively small amounts of other refrigerants the volume of liquid may be increased by the addition of an organic solvent, such as diethyl ether, carbon tetrachloride and chloroform. The volume of water 42 added to column 52 should bring the total volume to 90 percent of the column capacity.

The temperature of the system in the extraction column is preferably at or below room temperature and under elevated pressure. The extracting water 42 introduced near the top of the column slowly descends to the bottom of the column and collects as a lower aqueous layer 43 containing R-22. The refrigerant mixture rises towards the top of the extraction column. As the water passes through the mixed refrigerant solution it continually extracts the R-22 from the mixture until it collects and is withdrawn by opening valves 56 and 57 from the bottom of the column. The residual refrigerant phase containing the R-115 is withdrawn from the extraction column at line 54 by opening valve 58.

The R-22 refrigerant and water mixture collected in the reclaiming vessel 44 is then heated at reduced pressure or under vacuum to separate the refrigerant from the water. The R-22 rapidly boils off and is transferred to a reclaimer for reliquification. Water in the reclaiming vessel 44 is then available for recycling to the extraction column.

While the invention has been described in conjunction with various embodiments, they are illustrative only. Accordingly, many alternatives, modifications and variations will be apparent to persons skilled in the art in light of the foregoing detailed description, and it is therefore intended to embrace all such alternatives and variations as to fall within the spirit and broad scope of the appended claims.

We claim:

1. A method of purifying refrigerant compositions, which comprises the steps of:

(a) providing a refrigerant composition comprising at least first and second refrigerants in which the first refrigerant has a high water solubility relative to the second refrigerant;

(b) in a closed vessel, contacting the refrigerant composition of step (a) with an aqueous solution at a temperature sufficiently low to enhance the solubility and extraction of the first refrigerant from the refrigerant composition;

(c) allowing the aqueous solution of the extracted first refrigerant to separate into an upper aqueous phase and a lower liquid phase comprising the second refrigerant;

(d) separating said upper aqueous phase from said lower liquid phase, and (e) recovering the first refrigerant from said aqueous phase.

2. The method of claim 1 wherein said first and second refrigerants of step (a) are members selected from the group consisting of dichlorodifluoromethane, chlorodifluoromethane and chloropentafluoroethane.

3. The method of claim 1 wherein the aqueous solution of step (b) is water and the temperature is in a range from about 40° to about 120° F.

4. The method of claim 1 wherein the aqueous solution of step (b) is water and the temperature is in a range from about 65° to about 90° F.

5. The method of claim 2 wherein the aqueous solution of step (b) is water and the temperature is in a range from about 40° to about 120° F.

6. The method of claim 2 wherein the aqueous solution of step (b) is water and the temperature is in a range from about 65° to about 90° F.

7. The method of claim 3 wherein the refrigerant composition of step (a) includes an organic solvent.

8. The method of claim 3 wherein the aqueous phase of step (d) is transferred to a closed vessel, the temperature raised and pressure adjusted to maximize separation of the refrigerant from the water.

9. The method of claim 5 wherein the aqueous phase of step (d) is transferred to a closed vessel, the temperature raised and pressure adjusted to maximize separation of the refrigerant from the water.

10. The method of claim 3 wherein the refrigerant composition of step (a) comprises a mixture in which chlorodifluoromethane is the first refrigerant and dichlorodifluoromethane is the second refrigerant, said second refrigerant being the primary refrigerant.

11. The method of claim 3 wherein the refrigerant composition of step (a) comprises dichlorodifluoromethane as the first refrigerant and chloropentafluoroethane as the second refrigerant, said first refrigerant being the primary refrigerant.

12. The method of claim 3 wherein the refrigerant composition of step (a) comprises chlorodifluoromethane as the first refrigerant and chloropentafluoroethane as the second refrigerant.

13. A method of purifying refrigerant compositions, which comprises the steps of:

(a) providing a refrigerant composition comprising at least first and second refrigerants, said first refrigerant having a high water solubility relative to said second refrigerant;

(b) providing an aqueous solution having a temperature sufficiently low to enhance the solubility and extraction of said first refrigerant from the refrigerant composition of step (a);

(c) circulating a stream of the refrigerant composition of step (a) in a closed vessel countercurrently to a stream of the aqueous solution of step (b) for extraction of the first refrigerant by said aqueous solution;

(d) withdrawing the aqueous solution of step (c) comprising said extracted first refrigerant, and (e) recovering the first refrigerant from said aqueous solution to provide a first refrigerant suitable for recycling/reuse.

14. The method of claim 13 wherein the refrigerant composition of step (a) is dissolved in an organic solvent.

15. The method of claim 13 wherein the aqueous solution of step (b) is water and the temperature is in a range from about 40° to about 120° F.

16. The method of claim 13 wherein the aqueous solution of step (b) is water and the temperature is in a range from about 65° to about 90° F.

17. The method of claim 15 wherein the separation of the first refrigerant from the aqueous solution of step (e) is performed by raising the temperature and reducing the pressure sufficiently to accelerate recovery from said solution.

18. The method of claim 15 wherein the refrigerant composition of step (a) comprises an azeotrope in which chlorodiflucromethane is the first refrigerant and dichlorodifluoromethane is the second refrigerant, said second refrigerant being the primary refrigerant.

19. The method of claim 15 wherein the refrigerant composition of step (a) comprises dichlorodifluoromethane as the first refrigerant and chloropentafluoroethane as the second refrigerant, said first refrigerant being the primary refrigerant.

20. The method of claim 15 wherein the refrigerant composition of step (a) comprises chlorodifluoromethane as the first refrigerant and chloropentafluoroethane as the second refrigerant, said first refrigerant being the primary refrigerant.

* * * * *